United States Patent [19]

Tolbert

[11] Patent Number: 5,056,691

[45] Date of Patent: Oct. 15, 1991

[54] VALVED FUEL DISPENSING CONTAINER

[76] Inventor: Douglas Tolbert, 2014 Atlanta, Dear Park, Tex. 77536

[21] Appl. No.: 525,584

[22] Filed: May 21, 1990

[51] Int. Cl.[5] ..... B65D 83/00; B65D 3/00

[52] U.S. Cl. ..... 222/466; 222/472; 222/482; 222/517

[58] Field of Search ..... 222/465.1, 466–474, 222/478, 481, 481.5, 482, 483, 484, 505, 517, 556

[56] References Cited

U.S. PATENT DOCUMENTS

| | | | |
|---|---|---|---|
| 437,865 | 10/1890 | Moore | 222/472 X |
| 639,881 | 12/1899 | Bailey | 222/470 |
| 872,536 | 12/1907 | Nystrom | 222/472 |
| 1,034,897 | 8/1912 | Fusner | 222/470 X |
| 1,193,157 | 8/1916 | Krause et al. | 222/474 X |
| 1,331,409 | 2/1920 | Barnett | 222/466 X |
| 2,334,044 | 11/1943 | Swan | 222/472 X |
| 2,335,195 | 11/1943 | Packer . | |
| 2,490,194 | 12/1946 | Barclay | 222/556 |
| 2,815,892 | 12/1957 | Richmond Sr. | 222/470 |
| 3,927,797 | 12/1975 | Flider | 222/469 X |
| 4,781,314 | 11/1988 | Schoonover et al. | 222/465.1 |
| 4,805,808 | 2/1989 | Larson | 222/466 X |
| 4,923,098 | 5/1990 | Schoonover et al. | 222/482 X |

*Primary Examiner*—Kevin P. Shaver

*Attorney, Agent, or Firm*—Henderson & Sturm

[57] ABSTRACT

A valved fuel dispensing container device (10) including a valve member (31) disposed intermediate the inlet (22) and outlet (238) of the fuel nozzle (21) to give the user control over when the fule is allowed to flow past the valve member (31) and to minimize the risk of spillage and attendant evaporation either from the device (10) itself or with respect to a vessel to which the fuel is being transferred.

3 Claims, 1 Drawing Sheet

VALVED FUEL DISPENSING CONTAINER

TECHNICAL FIELD

The present invention relates to the field of dispensing containers in general, and in particular to a valve controlled dispensing container for materials such as gasoline.

BACKGROUND ART

This invention was the subject matter of Document Disclosure Program Registration No. 233,278 which was filed in the U.S. Patent and Trademark Office on Aug. 17, 1989.

As can be seen by reference to the following U.S. Pat. Nos. 2,335,195; 2,490,194; 2,815,892; and 3,927,797; the prior art is replete with myriad and diverse safety oriented dispensing cans.

While all of the aforementioned prior art constructions are more than adequate for the basic purpose and function for which they have been specifically designed, these devices obviously do not represent the culmination of technological advances possible in this area of technology.

As anyone who has ever poured gasoline from a portable container is well aware, most gas cans are not easy to handle, significant amounts of flammable vapors escape into the atmosphere, and the spilling of the gas is a common occurence. The most prevalent reason for the spilling of gas by the prior art devices is the poorly designed nozzle construction which has no means for controlling the flow of gas.

In addition, when a person is filling a gas tank, be it in a lawnmower, or in a car, the individual has to be very alert and pull the gas can away or tilt it up at the correct moment to insure there is no overflow or spillage.

Most prior art devices offer no quick shut off mechanism to stop the gas flow out of the container.

There is therefore an exhibited need for a portable gas can that has a hand triggered on-off valve, so that at any time during the filling of a gas tank, the user can stop the flow of fuel through the nozzle. While this particular function is especially important when topping off a gas tank, it will also prove of significant value if the user loses their balance or just needs to interrupt the filling to rest, considering how heavy a few gallons of gas can be. Realizing just how dangerous even a slight gas spill can be on and around operating engines, there is a great need for a device of this type. Furthermore, a gas spill can also pollute or ruin whatever surface the gas is spilled upon.

Based on the foregoing situation, it is obvious that there has existed a longstanding need among those individuals who have encountered this particular problem in the past. The provision of such a device is a stated objective of the present invention.

DISCLOSURE OF THE INVENTION

An object of this invention is to provide a device that will be able to safely and easily dispense a liquid such as gasoline.

Another object of the present invention is to provide a portable dispensing device with an elongated nozzle member for the pouring of the liquid.

Still another object of the present invention is to provide a dispensing device with a finger activated on-off valve located in the nozzle member which will enable the user to shut off the flow of liquid at any time while the container is tilted into the pouring position.

A further object of the present invention is to provide a dispensing device with a first handgrip member which can be used to position and hold the container steady while pouring.

Yet another object of the present invention is to provide a dispensing device with a second enlarged side handle member which can be used to carry the container.

Yet still another object of the present invention is to provide a dispensing device with a vent to aid in the pouring of the liquid.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
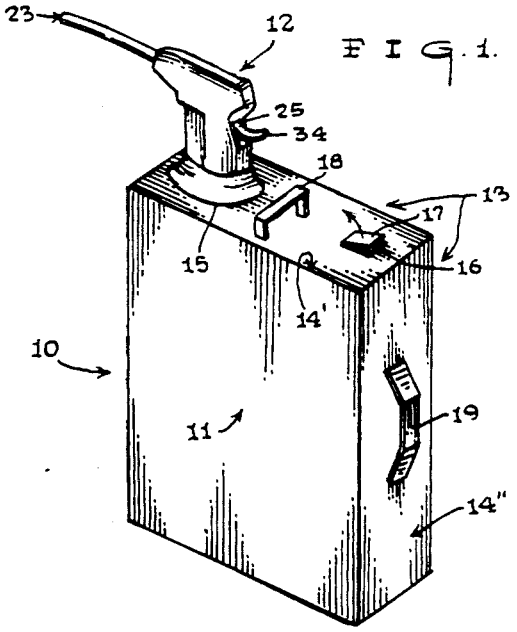
FIG. 1 is a perspective view of the invention.

As can be seen by reference to the drawings, and in particular to FIG. 1, the valved fuel dispensing container device that forms the basis of the present invention is designated generally by the reference numeral (10). The valved dispenser (10) comprises in general, a receptacle unit (11), a nozzle unit (12), and handle units (13). These units will now be discussed in seriatim fashion.

The receptacle unit (11) comprises in general, a container member (14) having an enlarged aperture (15) and a relatively discrete vent aperture (16) formed on the top (14') of the container member (14). The nozzle aperture (15) and the vent aperture (16) are spaced from one another for obvious reasons. In addition, the vent aperture (16) is further provided with a closure element (17) for controlling the flow of air through the vent aperture (16) in a well recognized fashion.

Still referring to FIG. 1, it can be seen that the handle units (13) comprise a plurality of handle members (18, 19). The upper handle member (18) is disposed on the top surface (14') of the container member (14) proximate to the nozzle aperture (15) and intermediate the nozzle aperture (15) and the vent aperture (16) and the other lower handle member (19) is disposed on the side (14'') of the container member (14) furthest from the location of the nozzle aperture (15).

Figure 2:
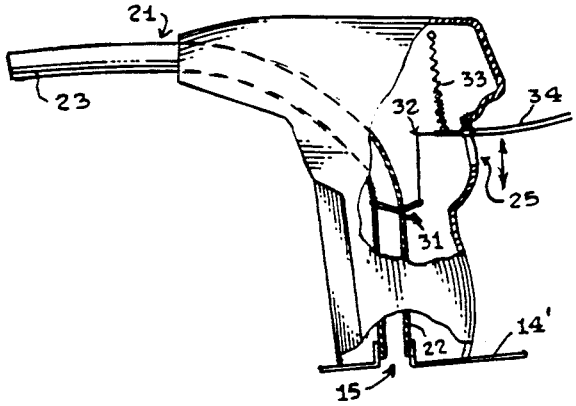
FIG. 2 is a partial cross sectional view of the nozzle.
Figure 3:
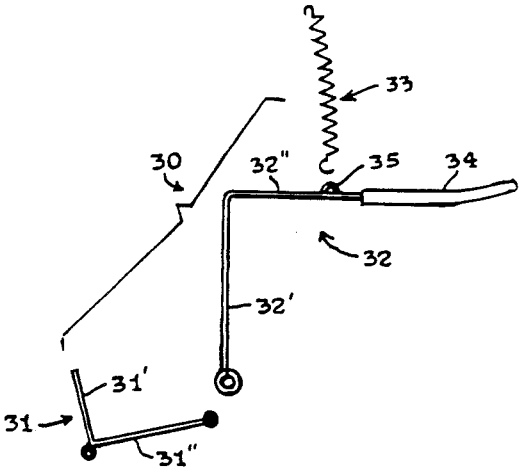
FIG. 3 is an exploded view of the shutt off valve.
Figure 4:
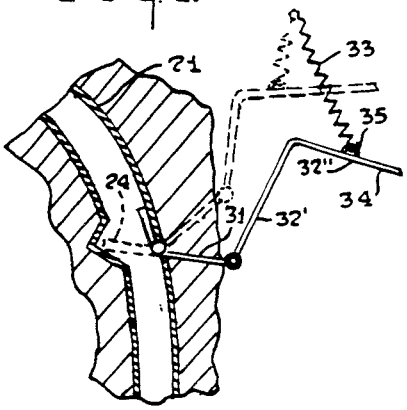
FIG. 4 is a cross-sectional view of the shut off valve in the nozzle.

Turning now to FIGS. 2 through 4, it can be seen that the nozzle unit (12) comprises a housing member (20) having an elongated open ended fluid nozzle (21) which is operatively associated with the housing member (20) and includes a nozzle inlet (22) disposed on the lower end of the housing member (20) and a nozzle outlet (23) which is disposed on the upper end of the housing member (20). Furthermore, the nozzle (21) is provided with an interior valve seat (24) and the housing member (20) is also provided with an elongated aperture (25) whose purpose and function will be described further on in the specification.

In addition, the nozzle unit (12) is further provided with a valve mechanism (30) which is operatively associated with the housing member (20) and the fluid nozzle (21). As can best be seen by reference to FIG. 3, the valve mechanism (30) comprises a pivoted generally L-shaped valve member (31), a pivoted generally L-shaped actuator member (32), and a spring biasing member (33).

As can best be seen by reference to FIGS. 2 and 4, the valve member (31) is pivotally disposed intermediate the inlet (22) and outlet (23) of the nozzle (21) at the juncture of the foot portion (31') and the leg portion (31") of the L-shaped valve member (31). The L-shaped actuator member (32) likewise is provided with a foot portion (32') and a leg portion (32"). The bottom end of the foot portion (32') of the actuator member (32) is pivotally connected to the top end of the leg portion (31") of the valve member (31) and the upper end of the leg portion (32") of the valve actuator (32) extends through the elongated aperture (25) in the housing member (20) and forms an actuator handle element (34).

As shown in FIGS. 2 through 4, the intermediate segment of the leg portion (32") of the valve actuator member (32) is provided with a floating pivot element (35). In addition, one end of the spring member (33) is attached to the floating pivot element (35) of the actuator member (32) and the other end of the spring member (33) is attached to the interior of the nozzle housing (20) whereby the actuator member (32) is suspended relative to the nozzle housing member (20) and the valve member (31) assumes a normally spring biased closed relationship relative to the valve seat (24) in the nozzle (21).

As can best be appreciated by reference to FIGS. 1 and 2, the upper handle member (18) is disposed in close proximity to the actuator handle element (34) such that the user may grasp the upper handle (18) with the fingers of one hand while using their thumb to depress the actuator handle element (34) to permit the flow of fuel through the nozzle (21) while the user's other hand is employed to grasp the lower handle (19) to tile the fuel container member (14) to maintain a constant supply of fuel at the nozzle inlet (22). Furthermore, it should be appreciated that the nozzle inlet (22) is intended to be threadably engaged to the nozzle aperture (15) in the fuel container member (14) in a well recognized manner.

It should further be appreciated that by positioning the valve seat (24) and valve member (31) intermediate the inlet (22) and outlet (23) of the nozzle (21) gives the user a more refined control over the positioning of the valve member (31) at either the inlet (22) or outlet (23) end of the nozzle (21).

In the first instance, virtually the entire fluid volume contained within the nozzle (21) will be either delivered to a vessel (not shown) which is presumably nearly brimming at the time the valve member (31) is actuated or, the fuel that is trapped between the valve member (31) and the nozzle outlet (23) will evaporate into the atmosphere creating a hazardous situation. In the second instance, there will be a substantial liquid slug contained within the nozzle (21) that will have a tendency to overcome the spring biasing applied to the valve member (31) which raises the likelihood of spilled fuel.

Having thereby described the subject matter of the present invention, it should be apparent that many substitutions and variations of the invention are possible in light of the above teachings. It is therefore to be understood that the invention as taught and described herein is only to be limited to the extent of the breadth and scope of the appended claims.

I claim:

1. A valved fuel dispensing container device for dispensing fuel into a vessel wherein the device comprises:

a container member having a nozzle aperture, a vent aperture, and a first handle member disposed proximate the nozzle aperture; and a nozzle unit including a housing member containing a nozzle having a nozzle inlet, a nozzle outlet, and a valve mechanism including a valve seat and a generally L-shaped valve member having foot and leg portions disposed intermediate said inlet and outlet; wherein, the nozzle inlet is adapted to be engaged in the nozzle aperture in the container member; and, a generally L-shaped actuator member pivotally secured on one end to the generally L-shaped valve member and suspended by a spring biasing element from the interior of said housing member; wherein, the generally L-shaped valve member is pivotally secured to the interior of the housing member at the juncture of the leg and foot portions of the generally L-shaped valve member; and, wherein the foot portion of the valve member is dimensioned to operatively engage the said valve seat.

2. The device as in claim 1 wherein said container member is further provided with a second handle member disposed at a spaced location relative to said first handle member.

3. The device as in claim 1; wherein, the other end of the generally L-shaped actuator forms an actuator handle.

* * * * *